US006707243B2

(12) United States Patent
Ito

(10) Patent No.: US 6,707,243 B2
(45) Date of Patent: Mar. 16, 2004

(54) COLOR CATHODE RAY TUBE HAVING AN IMPROVED SHADOW MASK SUPPORTING STRUCTURE

(75) Inventor: Yoichi Ito, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/254,422

(22) Filed: Sep. 24, 2002

(65) Prior Publication Data

US 2003/0057818 A1 Mar. 27, 2003

(30) Foreign Application Priority Data

Sep. 25, 2001 (JP) ..... 2001-292073

(51) Int. Cl.[7] ..... H01J 29/81; H01J 29/07; H01J 29/80

(52) U.S. Cl. ..... 313/404; 313/406

(58) Field of Search ..... 313/402, 403, 313/404, 405, 406, 407, 269

(56) References Cited

U.S. PATENT DOCUMENTS 4,827,180 A * 5/1989 Sone et al. ..... 313/404
5,012,154 A * 4/1991 Ragland, Jr. ..... 313/406
5,063,325 A * 11/1991 Ragland, Jr. ..... 313/405
6,037,709 A * 3/2000 Nakagawa et al. ..... 313/404
6,211,609 B1 4/2001 Bark et al.

* cited by examiner

*Primary Examiner*—Nimeshkumar D. Patel
*Assistant Examiner*—Mariceli Santiago
(74) *Attorney, Agent, or Firm*—Milbank, Tweed, Hadley & McCloy LLP

(57) ABSTRACT

A color cathode ray tube includes a shadow mask structure composed of a frame, a shadow mask attached to the frame and suspension springs attached to the frame, and studs embedded in a skirt portion of its panel portion. Each suspension spring is composed of a base member including a portion attached to the frame, a sloped portion extending from the portion toward the skirt portion, and a first joint portion extending axially from the sloped portion; and a spring member including a second joint portion fixed to the first joint portion, a resilient portion extending at an angle θ from the second joint portion, and a stud-engaging portion extending from the resilient portion and formed with a hole engaged with one of the studs, where $0° \leqq \theta \leqq 10°$. A length L of the resilient portion satisfies 20 mm≦L≦an axial length of the frame.

4 Claims, 13 Drawing Sheets

COLOR CATHODE RAY TUBE HAVING AN IMPROVED SHADOW MASK SUPPORTING STRUCTURE

BACKGROUND OF THE INVENTION

The present invention relates to a shadow mask type color cathode ray tube, and in particular to a color cathode ray tube of the type having its shadow mask supported at its corners.

As image or video display devices, shadow mask type color cathode ray tubes are widely used which employ a shadow mask which is formed with a large number of electron-transmissive apertures and serves as a color selection electrode.

A color cathode ray tube of this kind has an approximately rectangular panel portion having a spherical, flat or approximately flat outer surface and an inner surface which is convex toward the outer surface. Formed on the inner surface of the panel portion is a phosphor screen comprised of phosphor elements of a plurality of colors (usually three colors of red, green and blue) in the form of dots, continuous strips, or slots.

An electron gun for projecting a plurality (usually three) of electron beams onto the phosphor screen is housed within a neck portion integrally connected to the panel portion via a truncated-cone-shaped funnel portion so as to form a vacuum envelope.

Closely spaced from the phosphor screen on the inner surface of the panel portion is a shadow mask structure comprising a support frame (or a mask frame, or referred to merely as a frame) of a generally rectangular shape conforming to that of the panel portion, a generally rectangular shadow mask which is convex toward the phosphor screen and is attached to the support frame at its periphery, and suspension springs to be adapted to engage studs embedded in an inner sidewall of a skirt portion of the panel portion.

In this shadow mask structure, suspension springs (also called plate-like springs, or leaf springs) are attached to the support frame along the sides of the support frame at at least three points of the support frame as by welding. The free ends of the suspension springs are formed with engagement holes which are adapted to engage the studs embedded in the inner wall (the inner sidewall of the skirt portion) of the panel portion such that the shadow mask structure is supported and spaced by a specified distance from the phosphor screen.

Usually the suspension springs are disposed at the four sides of the generally rectangular support frame, or at three of the four sides, and necessarily studs are embedded at positions of the inner sidewall of the skirt portion of the panel portion corresponding to the engagement holes in the leaf springs.

However, as the size of the viewing screen of color cathode ray tubes has been increasing recently, the weight of the shadow mask structure, and in particular of the support frame has increased and it is difficult for the above-described plate-like suspension springs to support the shadow mask structure properly and compensate for its positional deviations (so-called doming or the like) caused by thermal expansion of the mask structure sufficiently.

As one of means for reducing the weight of the shadow mask structure, and in particular of its support frame, a method is known to be effective which reduces the thickness and the width of the support frame and attaches suspension springs at the corners of the support frame.

FIG. 7 is a schematic plan view of the shadow mask structure having the suspension springs attached at its corners, as viewed from the electron gun side of the color cathode ray tube. A phosphor screen 4 is formed on the inner surface of a panel portion 1. A shadow mask 6 of the shadow mask structure is disposed at a specified distance from the phosphor screen 4, and suspension springs 8 attached to the four corners of a support frame 7 engage studs 9 embedded in the inner wall of the skirt portion of the panel portion 1. Lines of action of the suspension springs 8 are arranged approximately in parallel with the tube axis as described subsequently.

SUMMARY OF THE INVENTION

It is an object of the present invention to provide a novel color cathode ray tube capable of compensating for a doming phenomenon occurring in a shadow mask properly and improving efficiency in the operation of removing and remounting the shadow mask structure.

The following describes a representative one of configurations of the present invention.

To accomplish the above objects of the present invention, in accordance with an embodiment of the present invention, there is provided a color cathode ray tube comprising: an evacuated envelope including a generally rectangular shallow dish-like panel portion having a peripheral skirt portion, a tubular neck portion, and a funnel portion for connecting said peripheral skirt portion of said panel portion and said neck portion; an electron gun housed within said neck portion; a phosphor screen formed on an inner surface of said panel portion; a shadow mask structure closely spaced from said phosphor screen within said panel portion, said shadow mask structure comprising a generally rectangular peripheral frame, a generally rectangular shadow mask attached to said peripheral frame and having an apertured portion formed with a multiplicity of electron-transmissive apertures, and suspension springs attached to corners of said peripheral frame corresponding to corners of said panel portion; and a plurality of studs embedded in an inner wall of said skirt portion at said corners of said panel portion for supporting said shadow mask structure, wherein each of said suspension springs comprises: a base member including an electron-gun-side end portion attached to said peripheral frame, a sloped portion extending from said electron-gun-side end portion toward said inner wall of said skirt portion of said panel portion, and a first joint portion extending in a direction of a longitudinal axis of said color cathode ray tube from said sloped portion; and a spring member including a second joint portion fixed to said first joint portion of said base member, a resilient sloped portion extending at a tilt angle $\theta$ from said second joint portion of said spring member toward said inner wall of said skirt portion of said panel portion, and a stud-engaging portion extending from said resilient sloped portion, bent from a plane of said resilient sloped portion toward said peripheral frame, and formed with an engagement hole to be engaged with a corresponding one of said plurality of studs, and a length L of said resilient sloped portion satisfies the following inequality: 20 mm$\leqq$L$\leqq$an axial length of said frame, and said tilt angle $\theta$ satisfies the following inequality: $0° \leqq \theta \leqq 10°$, where said tilt angle $\theta$ is an angle measured in a state where said engagement hole is engaged with said corresponding one of said plurality of studs.

The present invention is not limited to the above configurations, and various changes and modifications may be made without departing from the scope of the invention as defined in the appended claims.

BRIEF DESCRIPTION OF THE DRAWINGS

In the accompanying drawings, in which like reference numerals designate similar components throughout the figures, and in which.

DETAILED DESCRIPTION

Figure 8:
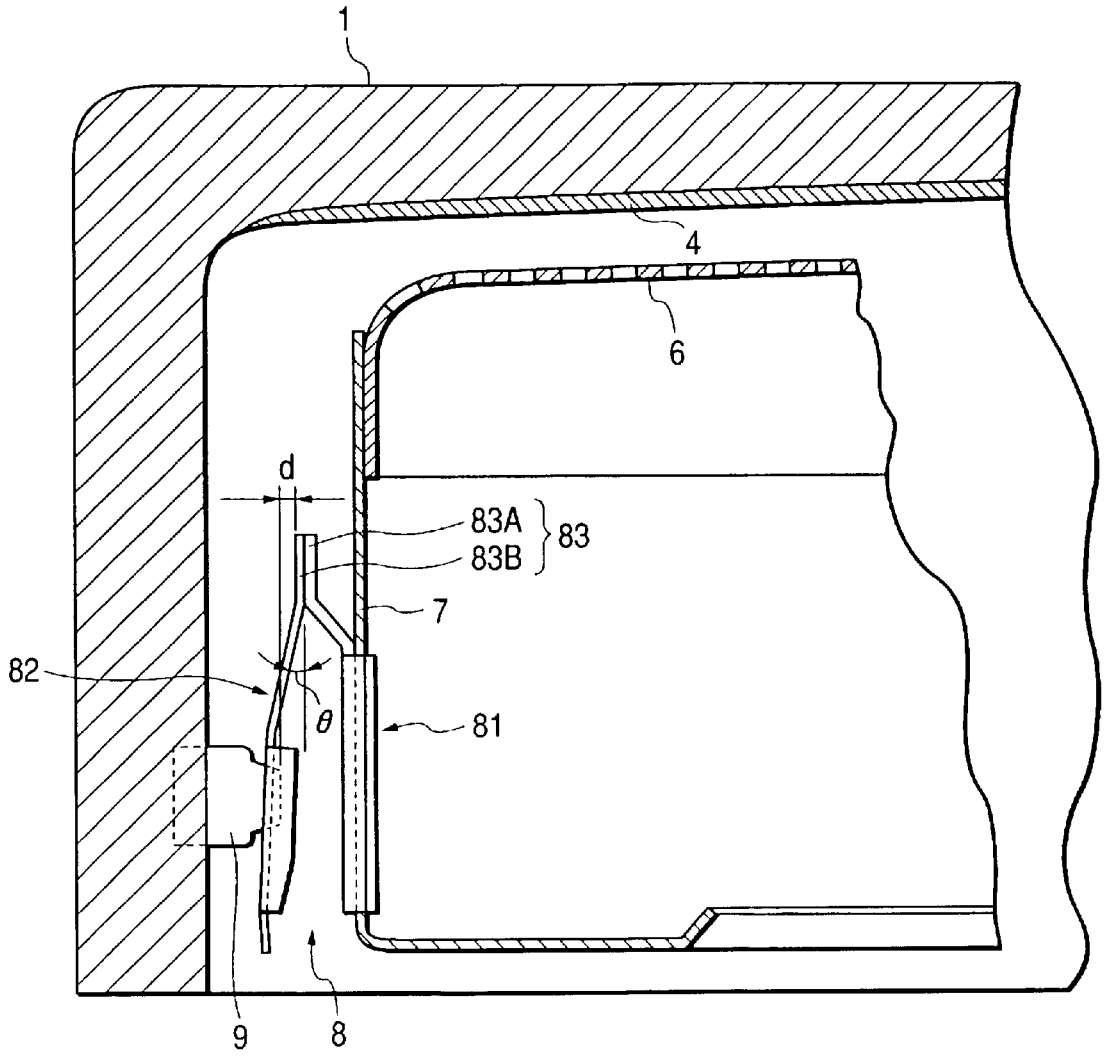
FIG. 8 is a cross-sectional view of an essential part of a panel portion of a conventional color cathode ray tube taken along a plane parallel with its tube axis for explaining a condition of a shadow mask structure mounted within the panel portion.

FIG. 8 is a cross-sectional view of an essential part of a panel portion of a conventional color cathode ray tube taken along a plane parallel with its tube axis for explaining a condition of the shadow mask structure mounted within the panel portion. In FIG. 8, reference numeral 1 denotes the panel portion, and studs 9 are embedded into the inner wall of the periphery (the panel skirt portion) of the panel portion 1 at the corners of the panel portion 1.

Formed on the inner surface of the panel portion 1 serving as a viewing screen is a phosphor screen 4 comprised of a mosaic of different-color-emitting phosphor areas. The base members 81 of the suspension springs 8 are fixed to the support frame 7 of the shadow mask structure, and engagement holes formed in the spring members 82 of the suspension springs 8 engage the studs 9, and thereby the shadow mask 6 is disposed at a specified distance from the phosphor screen 4.

During operation of the color cathode ray tube, the shadow mask 6 is deformed due to its temperature rise, and moves toward the phosphor screen 4 as a whole, which is the so-called doming phenomenon, and consequently, electron beams passing through electron-transmissive apertures in the shadow mask 6 do not impinge upon intended phosphor elements properly and thereby cause color misregister.

For the purpose of reducing the degree of doming, the shadow mask 6 is made of Invar (an iron-nickel alloy containing about 36 percent nickel) material having a low coefficient of thermal expansion. On the other hand, the support frame 7 and the suspension springs 8 are made of steel, and consequently, the amounts of distortions of the support frame 7 and the suspension springs 8 due to temperature rise become greater than the amount of distortion of the shadow mask 6.

In FIG. 8, the amount of compensation of the doming phenomenon by the suspension spring 8 is determined by a tilt angle θ of the spring member 82. The suspension spring 8 is attached such that it compensates for the above-explained doming by absorbing thermal distortion of the shadow mask 6 and the support frame 7, but, when the shadow mask made of material of a low thermal coefficient of expansion is employed, the suspension spring 8 compensates for the amount of doming more than necessary, that is, the suspension spring 8 overcompensates for doming.

For reducing the amount of doming compensation by the suspension spring 8, it is necessary to dispose the joint portions 83 (83A, 83B) of the suspension spring 8 shown in FIG. 8 as close to the inner wall of the skirt portion of the panel portion 1 as possible.

However, if the joint portion 83 of the suspension spring 8 is disposed closer toward the inner wall of the skirt portion of the panel portion 1, the spacing between the joint portion 83 and the top of the stud 9 becomes smaller, and consequently, the joint portion 83 and the stud 9 interfere with each other (contact or collision) in removing and remounting of the shadow mask structure during the operation of coating the phosphor screen 4, and as a result the stud 9 is destroyed, or the need for avoiding the interference degrades operation efficiency.

Figure 9:
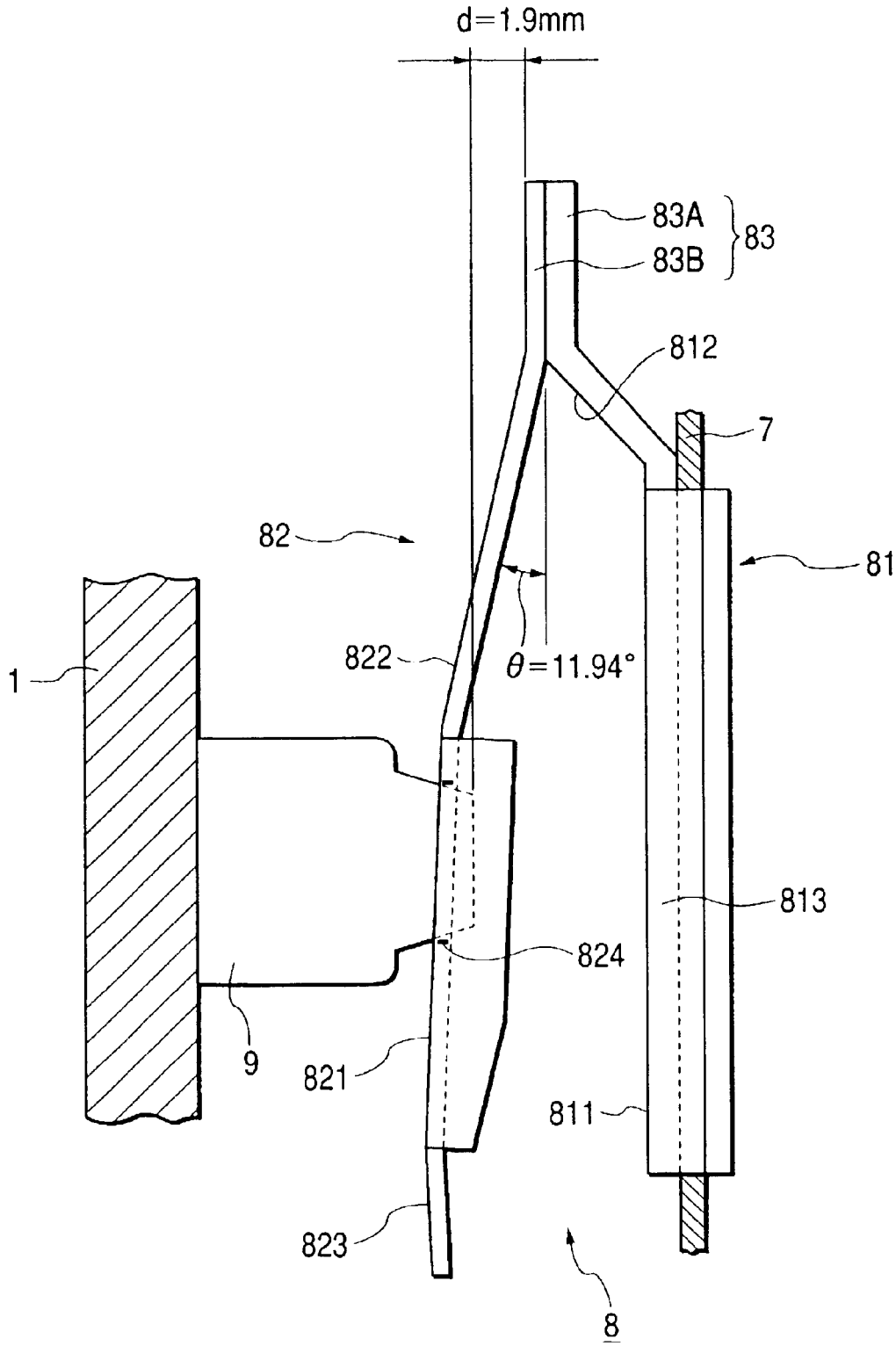
FIG. 9 is a cross-sectional view of an essential part of a panel portion of a color cathode ray tube taken along a plane parallel with its tube axis for explaining a condition of a shadow mask structure mounted within the panel portion wherein an angle θ between a sloped portion of a spring member and a base member is reduced by disposing a joint portion of the suspension spring closer toward an inner wall of a skirt portion of the panel portion.

FIG. 9 is an illustration for explaining a minimum interference-free distance between the stud 9 and the suspension spring 8 which produces a large amount of doming compensation. In FIG. 9, reference numeral 81 denotes a base member attached to the frame 7, 811 is a flat portion, 812 is a sloped portion, 813 is a stepped portion, 82 is a spring member, 821 is a flat portion (an engagement portion) formed with an engagement hole 824 adapted to engage with a stud 9, and 822 is a sloped portion (a spring-operating portion).

When the accuracy of actual operation of a machine for removing and remounting of the shadow mask structure is taken into account, the minimum interference-free distance d mm between the stud 9 and the joint portion 83B of the suspension spring 8 is about 1.9 mm, and this minimum interference-free distance of 1.9 mm corresponds to a required tilt angle θ of 11.94 degrees of the spring member 82 with respect to the joint portion 83.

When the shadow mask 6 is made of Invar, the suspension spring 8 having the tilt angle of such a value provides an excessive amount of doming compensation, and therefore cannot eliminate color misregister caused by temperature rise.

Figure 10:
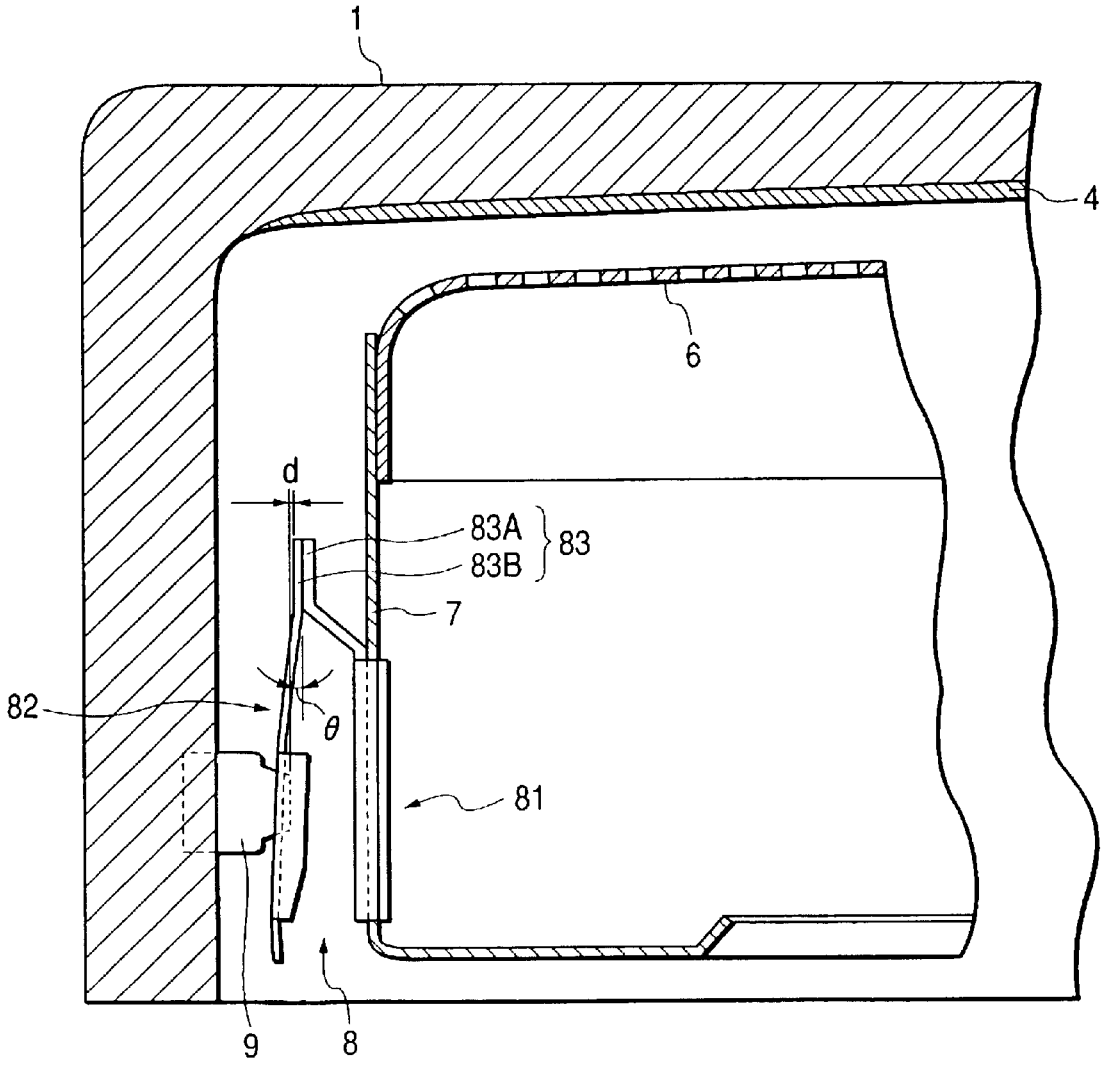
FIG. 10 is a cross-sectional view of an essential part of a panel portion 1 of a color cathode ray tube taken along a plane parallel with its tube axis when a joint portion of a suspension spring is disposed closer toward an inner sidewall of the skirt portion of the panel portion so as to decrease a tilt angle θ.
Figure 11:
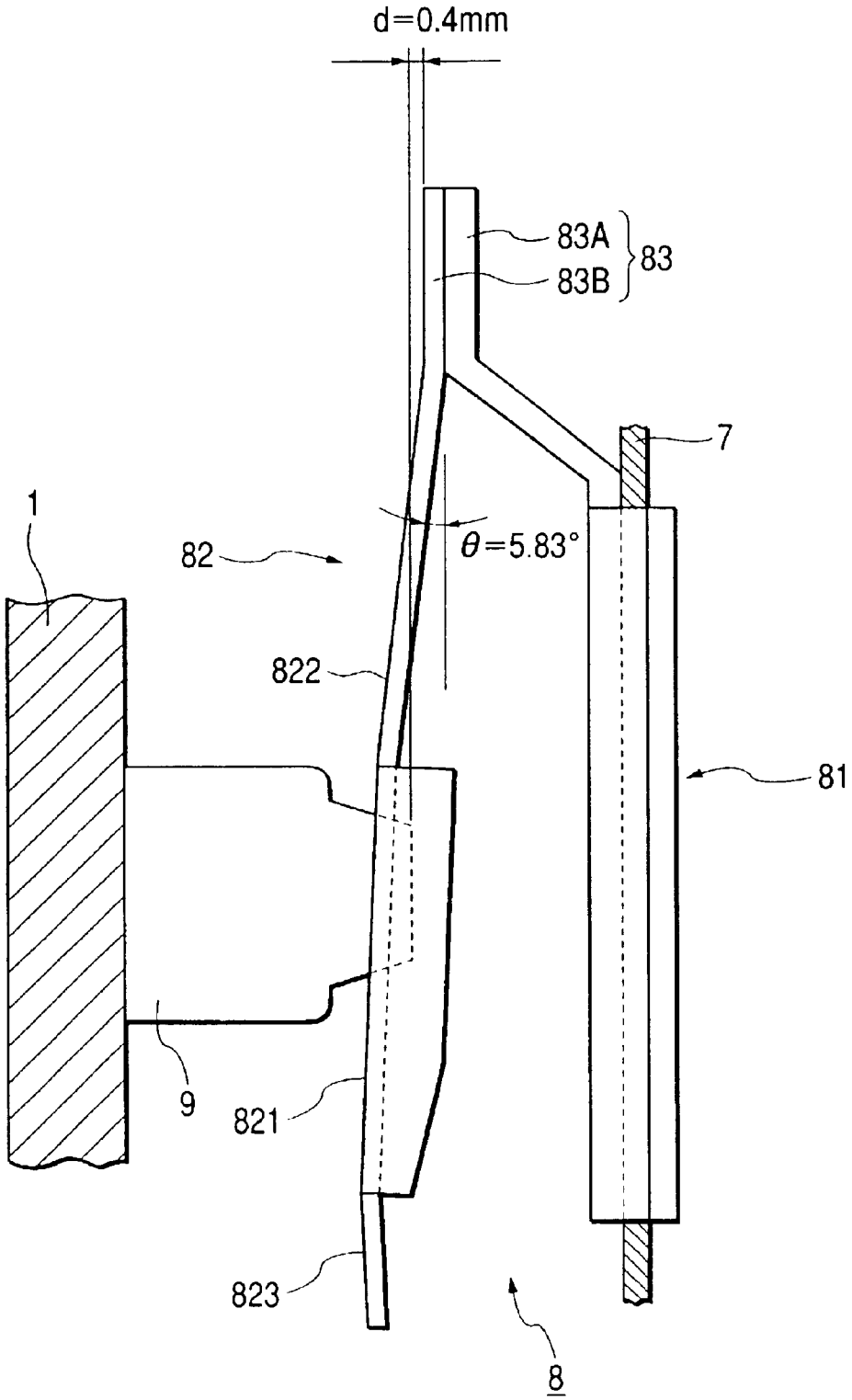
FIG. 11 is an enlarged view of the suspension spring and its attachment position of FIG. 10.

FIG. 10 is a cross-sectional view of an essential part of a panel portion 1 of a color cathode ray tube taken along a plane parallel with its tube axis when the joint portion 83 of the suspension spring 8 is disposed closer toward the inner sidewall of the skirt portion of the panel portion 1 so as to decrease the tilt angle θ, and FIG. 11 is an enlarged view of the suspension spring 8 and its attachment position of FIG. 10.

With the structure shown in FIGS. 10 and 11, the amount of doming compensation can be reduced by selecting the tilt angle θ to be 5.83 degrees which is smaller than the above-mentioned tilt angle, and consequently, the above-explained overcompensation can be avoided. However, the minimum interference-free distance d mm between the stud 9 and the joint portion 83 of the suspension spring 8 become about 0.4 mm, and consequently, it is practically difficult to remove the shadow mask structure from and remount the shadow mask structure into the panel portion 1.

A prior art document, U.S. Pat. No. 6,211,609 B1, discloses findings on relationship between a spacing between base and spring members and a length of the spring member in a suspension spring of this kind. But this prior art does not consider the above-explained minimum interference-free distance in the operation of removing the shadow mask from and remounting the shadow mask structure into the panel portion. As explained above, with conventional configurations of suspension springs, desired doming compensation is not compatible with removing and remounting of the shadow mask structure, and this has been one of problems with the conventional color cathode ray tubes. It is an object of the present invention to provide a color cathode ray tube provided with suspension springs having optimized the amount of doming compensation and increased the minimum interference-free distance in the operation of removing and remounting the shadow mask structure.

The embodiments of a color cathode ray tube in accordance with the present invention will now be explained in detail by reference to the drawings.

Figure 1:
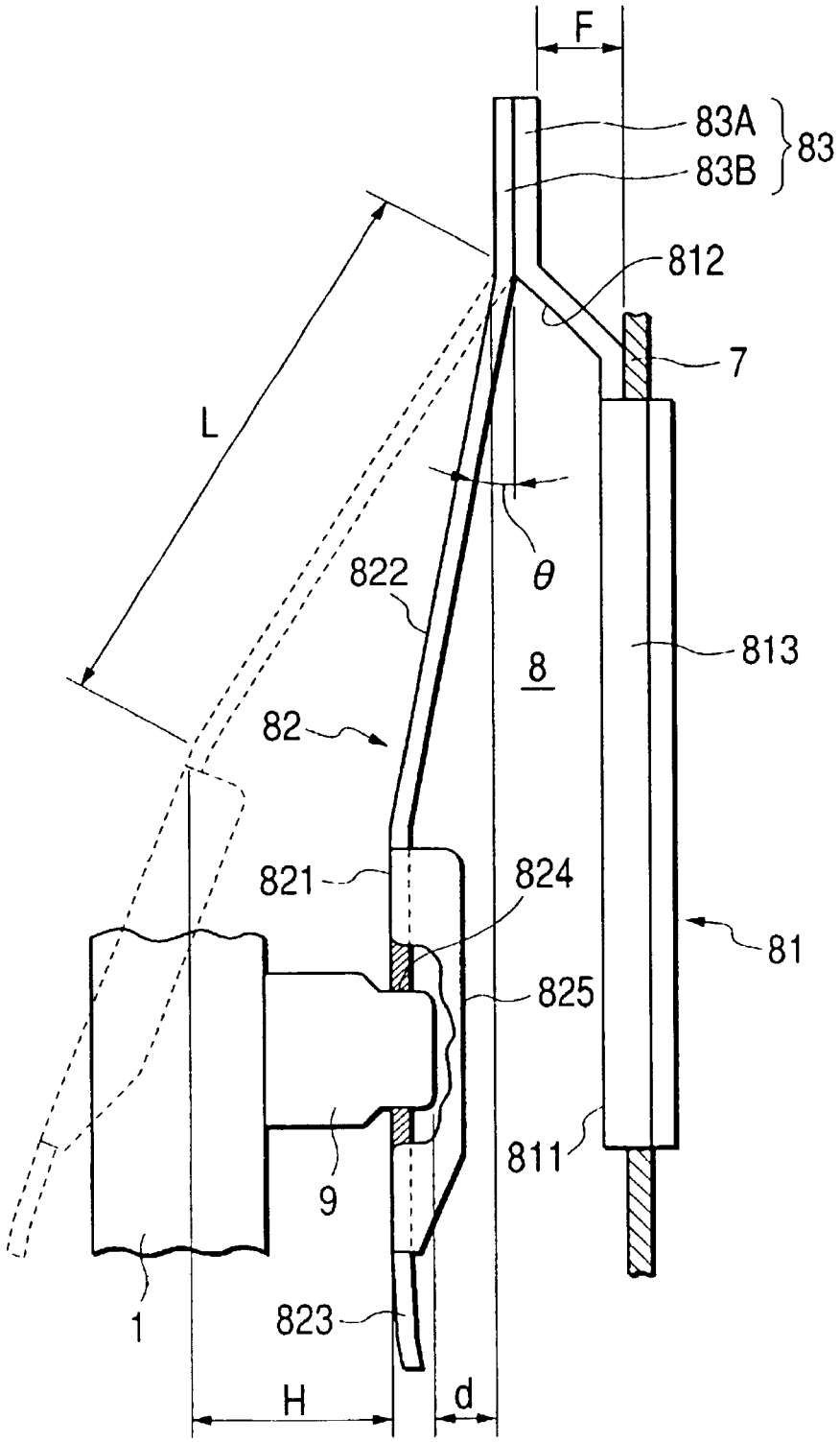
FIG. 1 is an illustration of a suspension spring employed in an embodiment of the color cathode ray tube in accordance with the present invention.
Figure 2:
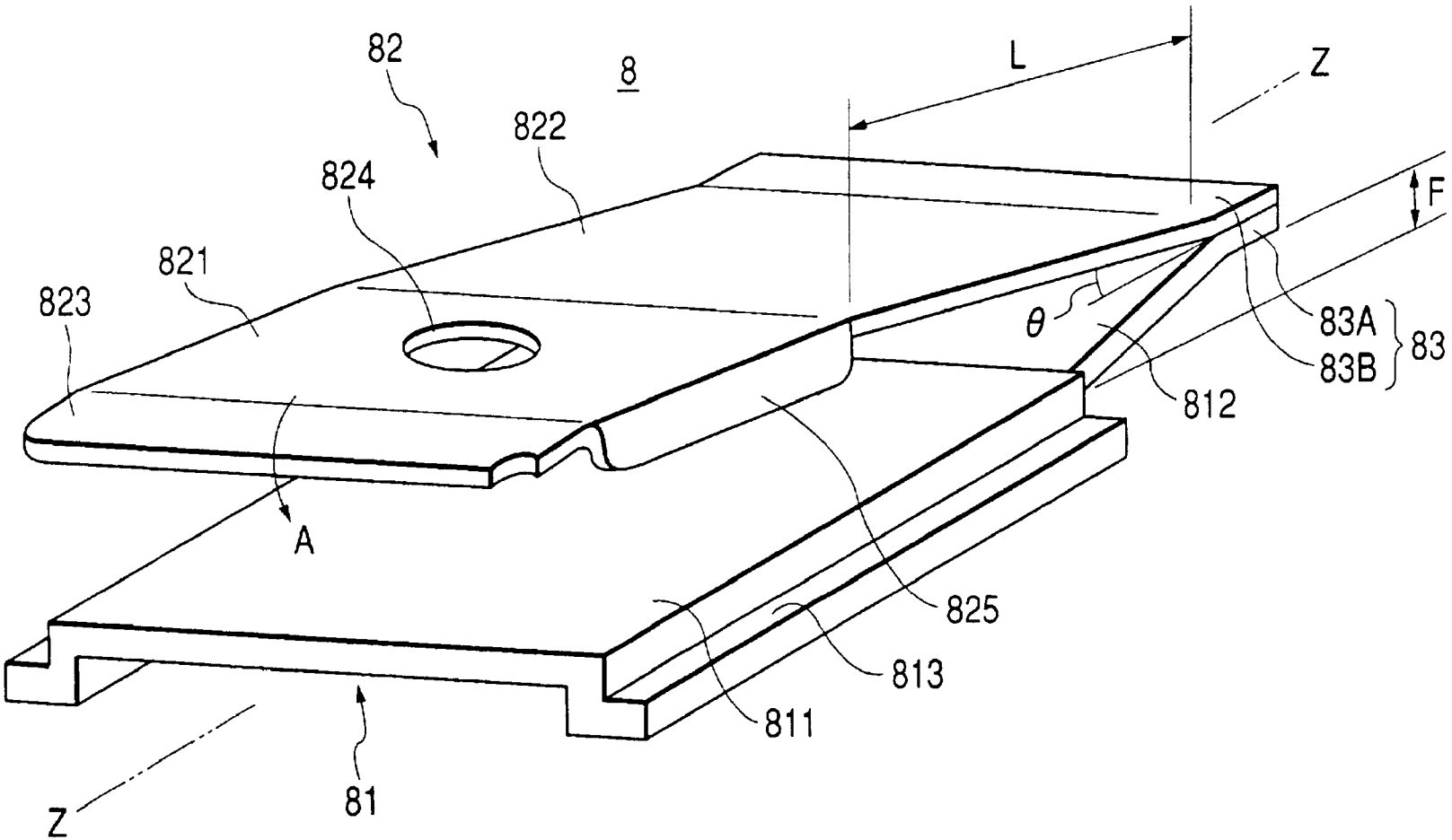
FIG. 2 is a perspective view of the suspension spring of FIG. 1.

FIG. 1 is an illustration of a suspension spring 8 employed in an embodiment of the color cathode ray tube in accordance with the present invention, and FIG. 2 is a perspective view of the suspension spring of FIG. 1. The suspension spring 8 has its longer dimension in parallel with an axis Z—Z of the color cathode ray tube, and comprises a base member 81 fixed to a frame 7 (see FIG. 1) of a shadow mask structure and a spring member 82 to be urged against a stud 9 embedded in an inner wall of a skirt portion of a panel portion 1. The base member 81 and the spring member 82 are fixed together at their joint portions 83 (83A, 83B). The base member 81 is formed with a stepped portion 813 fixed to a fixing groove (not shown) provided in the frame 7 and a sloped portion 812 continuous with the joint portion 83A. The spring member 82 is composed of a sloped portion 822 formed continuously with the joint portion 83B, a flat portion 821 continuous with the sloped portion 822, and formed with an engagement hole 824 to engage the stud 9, and a tongue 823, and bent portions 825 provided on both sides of the flat portion 821 for securing the mechanical strength. In the operation of engaging and disengaging the suspension spring 8, the tongue 823 engages a gripper of a robot or the like so that the spring member 82 is depressed toward the base member 81 in a direction of an arrow A indicated in FIG. 2. In FIG. 1, the location of the spring member 82 engaged with the stud 9 is indicated by the solid lines, and that of the spring member 82 disengaged from the stud 9 is indicated by the broken lines.

The base member 81 fixed to the frame 7 is provided with the sloped portion 812 extending to a position at a distance F from the frame 7 and the joint portion 83A continuous with the sloped portion 812, and the spring member 82 is disposed such that a plane containing the outside surface of the joint portion 83B of the spring member 82 is at a distance d from a tip of the stud 9.

The sloped portion 822 of the spring member 82 is formed integrally with the joint portion 83B to make an angle θ with respect to the joint portion 83 and has a length of L. The flat portion 821 formed with the engagement hole 824 to be engaged with the stud 9 is formed continuously with the sloped portion 822. A dimension H indicated in FIG. 1 denotes a shift between a flat portion 821 side end of the sloped portion 822 in a disengaged state before the spring member 82 is engaged with the stud 9 and that in an engaged state after the spring member 82 has been engaged with the stud 9, measured in a direction perpendicular to the tube axis. The above-explained dimension H may be hereinafter referred to merely as the engaged-disengaged spring-member shift H.

In this embodiment, the tilt angle θ of the sloped portion 822 with respect to the joint portion 83B is 9.3 degrees, a spacing d between a panel-skirt-side surface of the joint portion 83B of the spring member 82 and the tip of the stud 9 measured in the direction perpendicular to the tube axis is 2.4 mm, and a spacing F between the joint portion 83A and the frame 7 is 3.0 mm. The length L of the sloped portion 822 is 20 mm, and the engaged-disengaged spring-member shift H between locations of the border line between the sloped portion 822 and the flat portion 821 in the disengaged state before the engagement of the spring member 82 with the stud 9 and in the engaged state after the engagement of the spring member 82 with the stud 9, respectively, is 5 mm.

Figure 3A:
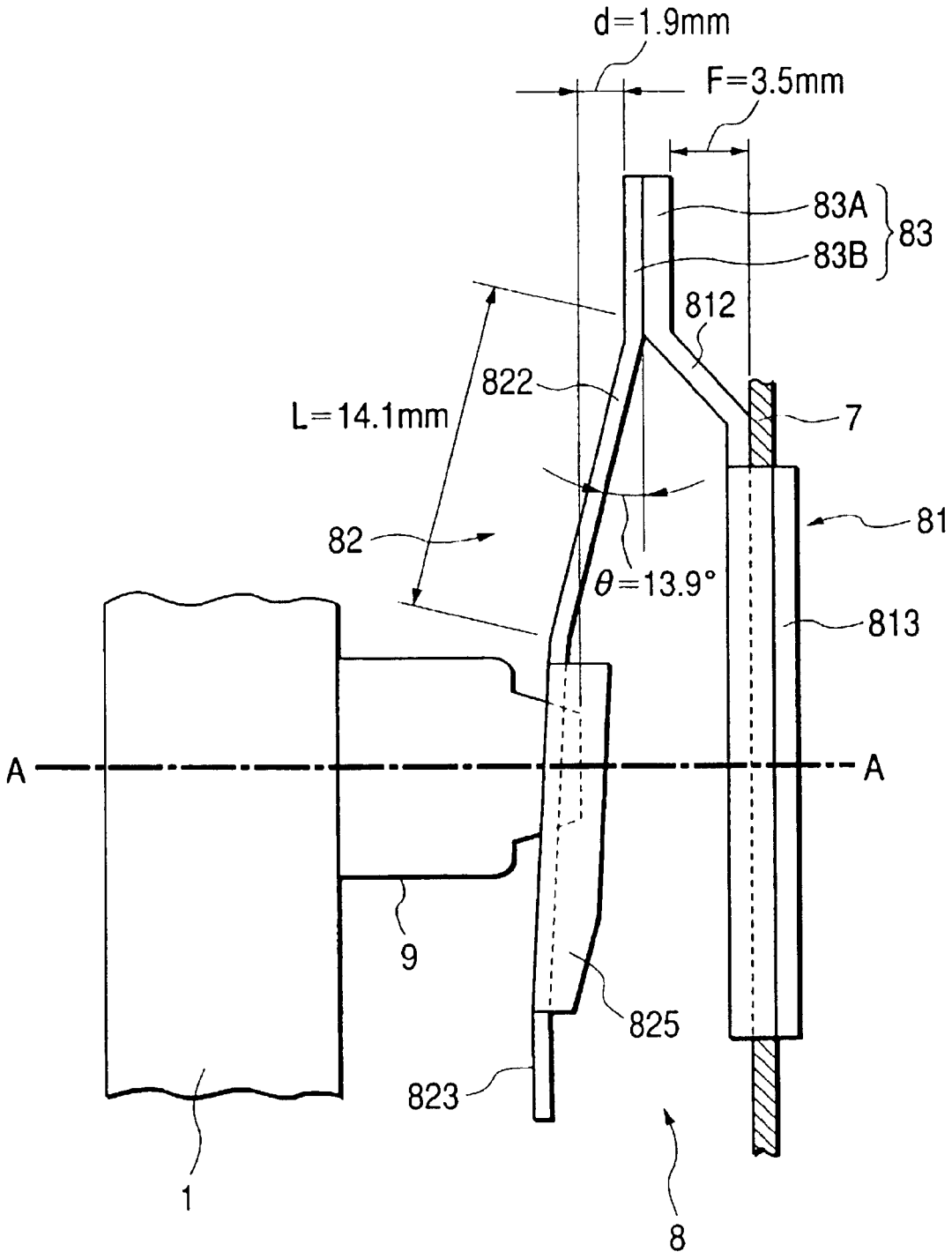
FIGS. 3A–3C are illustrations of states of a conventional suspension spring, a suspension spring proposed by the present inventor in a developmental stage and an embodiment of the suspension spring in accordance with the present invention, respectively, engaged with a stud, for comparison purposes.
Figure 3B:
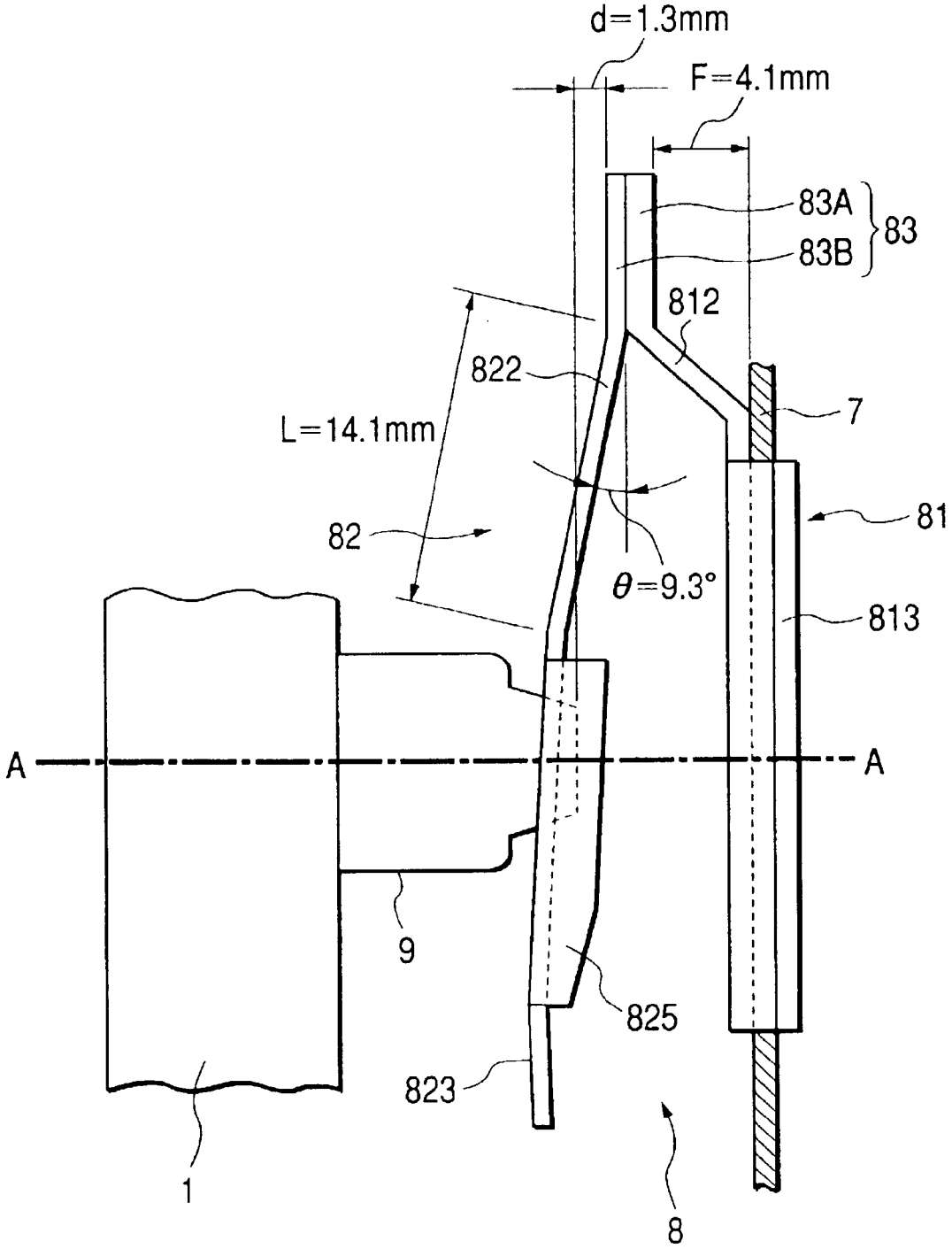
Figure 3C:
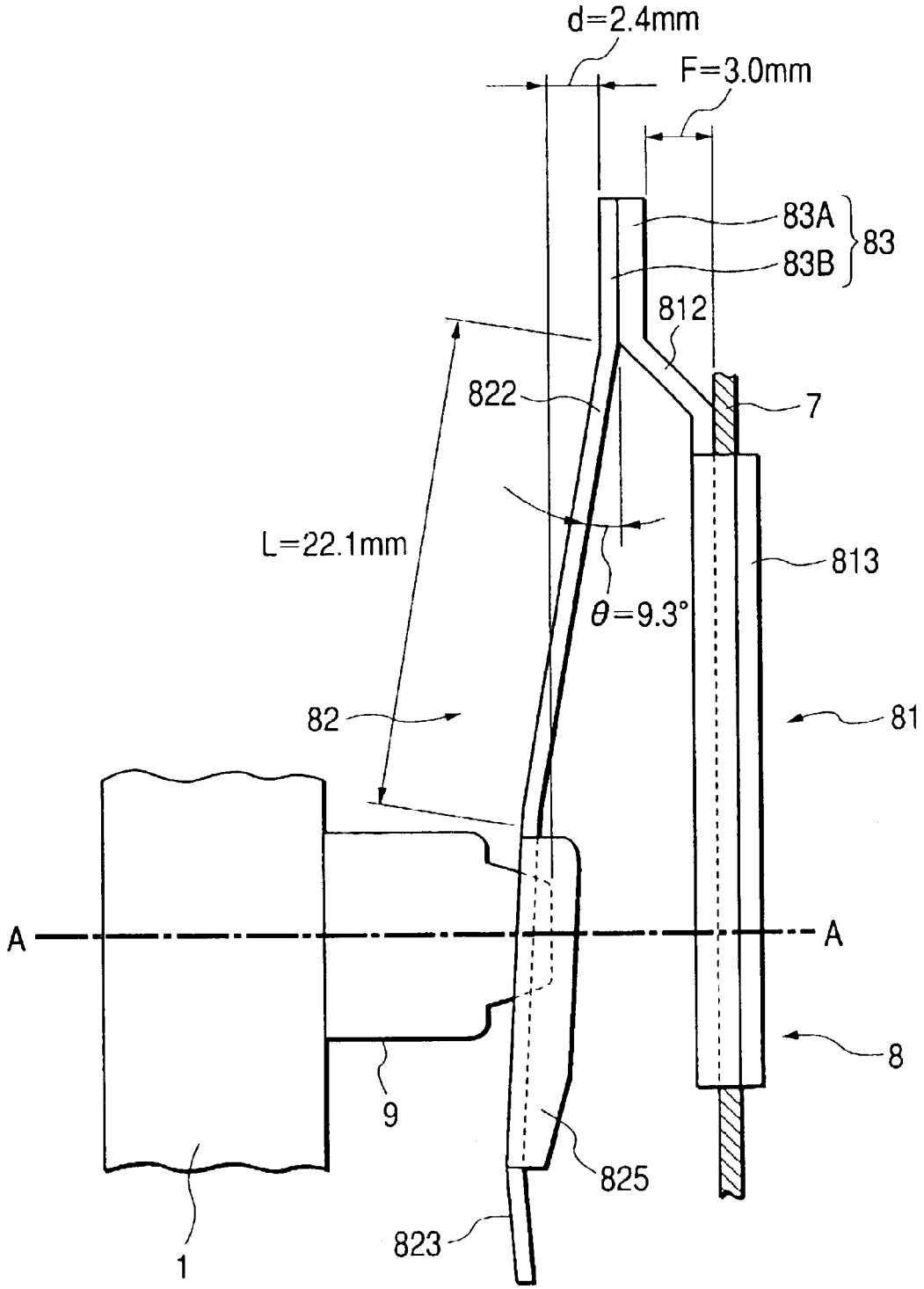

FIGS. 3A–3C are illustrations of states of a conventional suspension spring, a suspension spring proposed by the present inventor in a developmental stage and an embodiment of the suspension spring in accordance with the present invention, respectively, engaged with the stud 9, for comparison purposes. FIG. 3A illustrates a case in which the conventional suspension spring was employed, FIG. 3B illustrates a case in which the suspension spring made on the experimental basis was employed, and FIG. 3C illustrates a case in which the suspension spring in accordance with an embodiment of the present invention was employed. The same reference numerals as utilized in FIGS. 1 and 2 designate functionally similar portions in FIGS. 3A to 3C. In FIGS. 3A–3C, lines A—A denote the center line of the stud 9.

In FIG. 3A, the spacing F between the joint portion 83A of the base member 81 of the suspension spring 8 and the frame 7 is 3.5 mm, the tilt angle θ of the sloped portion 822 of the spring member 82 is 13.9 degrees with respect to the joint portion 83B, the length L of the sloped portion 822 of the spring member 82 is 14.1 mm, and the spacing d between the joint portion 83B and the tip of the stud 9 is 1.9 mm. The amount of the above-described doming compensation of such suspension springs can be optimized by making the tilt angle θ of the sloped portion 822 of the spring member 82 smaller.

FIG. 3B illustrates a case in which the tilt angle θ of the sloped portion 822 of the spring member 82 of the suspension spring 8 is made smaller than in the case explained in connection with FIG. 3A. In FIG. 3B, the length L of the sloped portion 822 of the spring member 82 is 14.1 mm as in the case of FIG. 3A, but the tilt angle θ of the sloped portion 822 of the spring member 82 is selected to be 9.3 degrees with respect to the joint portion 83B. Reduction of the tilt angle θ to 9.3 degrees necessarily increases the spacing F between the joint portion 83A and the frame 7, and in this case the spacing F became 4.1 mm. Consequently, the spacing d between the joint portion 83B and the tip of the stud 9 became 1.3 mm, which is too small.

The spacing d of 1.9 mm obtained in the case of FIG. 3A is the minimum acceptable for actual removing and remounting of the shadow mask structure, and if the spacing d is 1.3 mm, the joint portion 83B of the suspension spring 8 may contact the stud 9, and as a result, the stud 9 may be destroyed, or the suspension spring 8 may be deviated from its intended location. Therefore the mere reduction of the tilt angle θ of the sloped portion 822 of the suspension spring 8 presents those practical problems. FIG. 3C illustrates a suspension spring in accordance with an embodiment of the present invention configured so as to eliminate the above problems.

In FIG. 3C, the amount of the doming compensation is optimized by selecting the tilt angle θ of the sloped portion 822 of the spring member 82 to be 9.3 degrees with respect to the joint portion 83B, and at the same time the length L of the sloped portion 822 is lengthened to 22.1 mm. Here the spacing d between the joint portion 83B and the tip of the stud 9 is increased to 2.4 mm by reducing the spacing F between the joint portion 83A and the frame 7, to 3.0 mm. With this configuration, the joint portion 83B of the suspension spring 8 does not contact the stud 9 during the operations of removing the shadow mask structure from the panel portion 1 and remounting of the shadow mask structure into the panel portion 1, and consequently, the shadow mask structure is capable of being removed from and remounted into the panel portion 1 easily.

Figure 4:
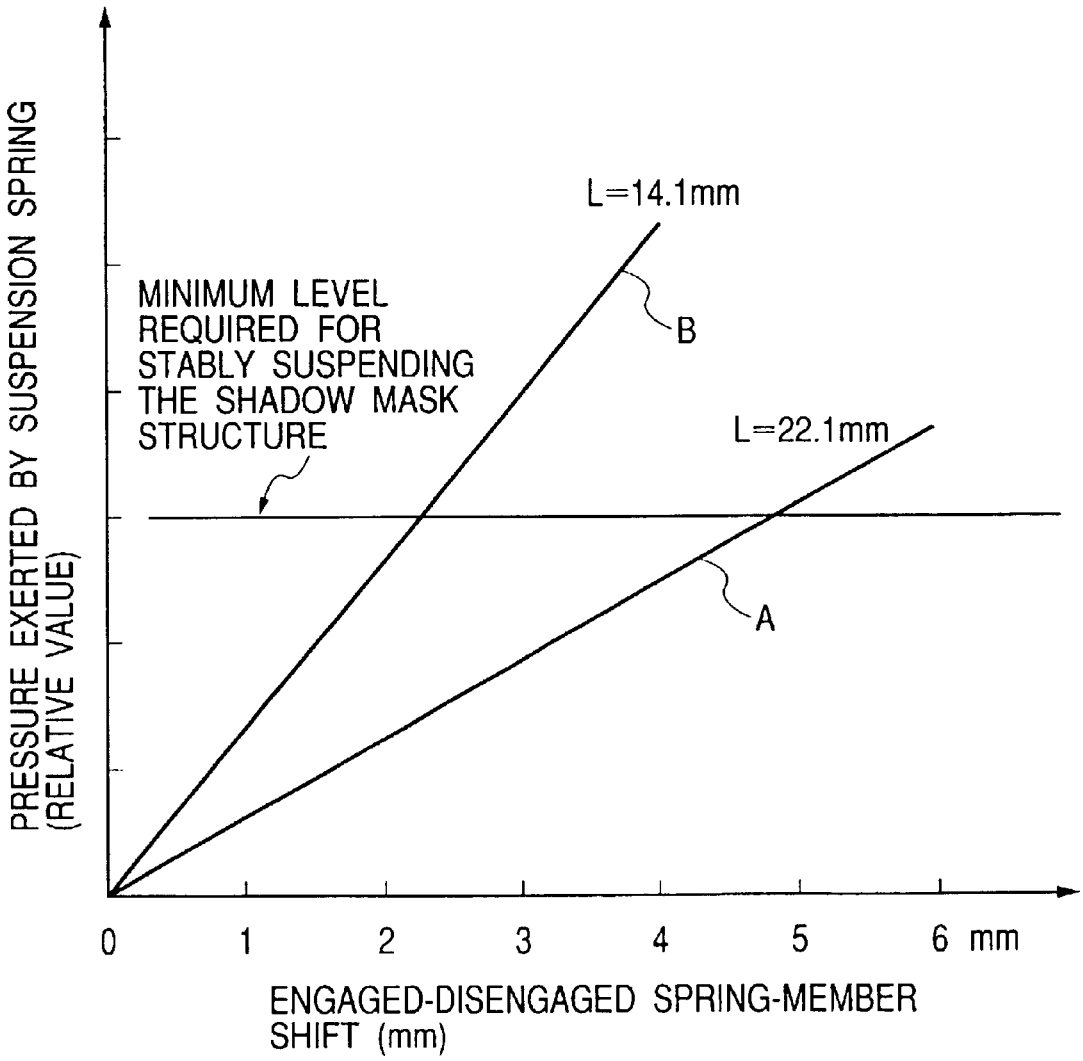
FIG. 4 is a graph showing a relationship between an engaged-disengaged spring-member shift and a pressure exerted by a suspension spring against a stud with a length of a sloped portion of a spring member of the suspension spring as a parameter.

FIG. 4 is a graph showing a relationship between the engaged-disengaged spring-member shift H (see FIG. 1) and the pressure exerted by the suspension spring against the stud 9 with the length L of the sloped portion 822 of the spring member 82 of the suspension spring 8 as a parameter. The pressures exerted by the suspension spring against the stud 9 are expressed in relative value. In FIG. 4, curve A represents a characteristic of the suspension spring 8 explained in connection with FIG. 3C, and curve B represents a characteristics of the conventional suspension spring 8 explained in connection with FIG. 3A. As is apparent from the comparison between the curves A and B, if the length L of the sloped portion 822 of the suspension spring 8 which produces spring action is increased, the suspension spring does not exert a sufficient pressure against the stud for stably suspending the shadow mask structure unless the engaged-disengaged spring-member shift H is increased.

In view of the this fact, in this embodiment, the suspension strength of the shadow mask structure by the suspension spring is secured by selecting the engaged-disengaged spring-member shift H (see FIG. 1) to be 5 mm or more. As explained above, in this embodiment, the amount of doming compensation is not only optimized, but the ease of removing and remounting of the shadow mask structure is also increased, resulting in its increased workability.

Figure 5:
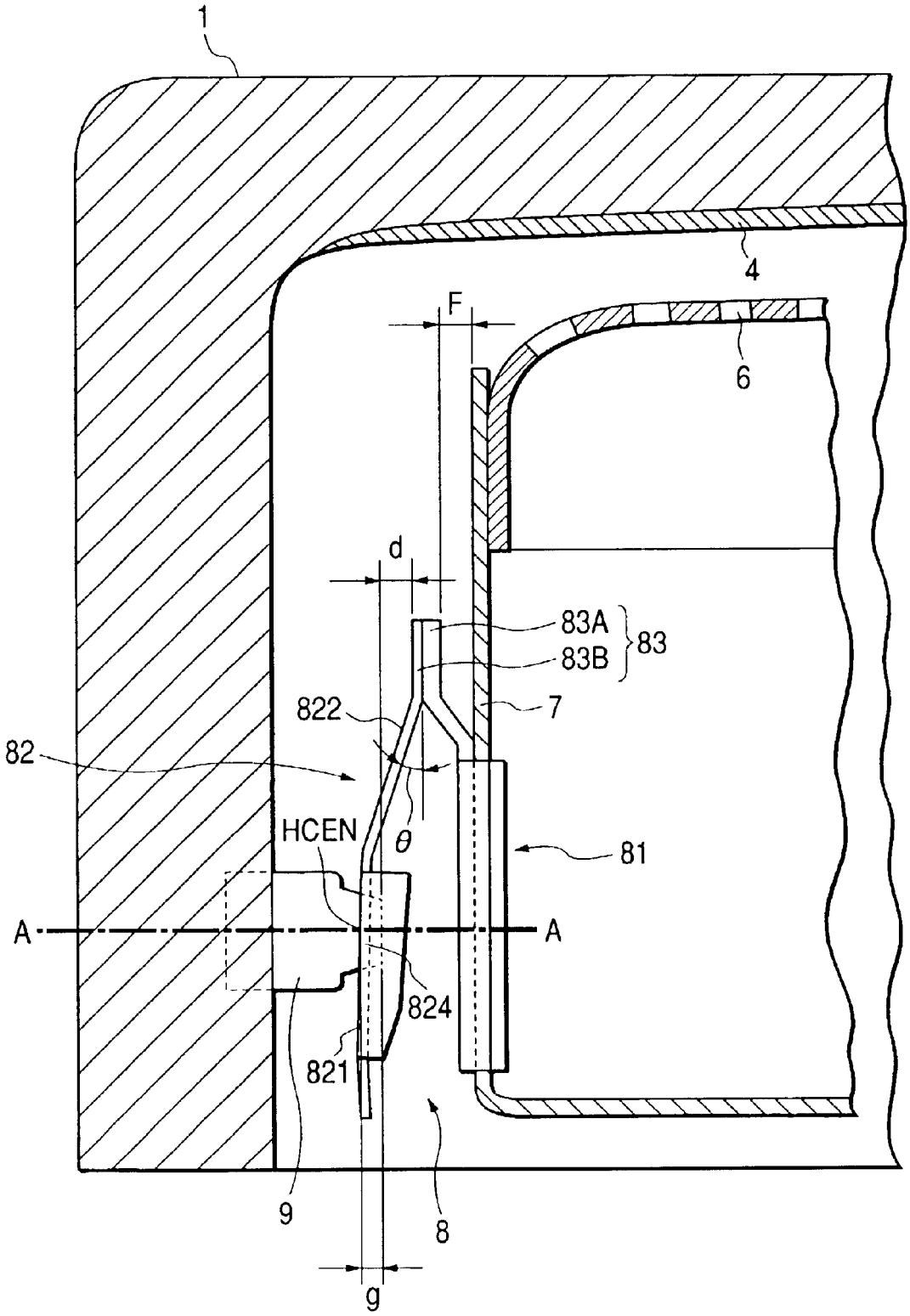
FIG. 5 is a cross-sectional view of an essential part of a panel portion of an embodiment of the color cathode ray tube in accordance with the present invention, taken in a plane parallel with its tube axis, for explaining the condition of a shadow mask structure mounted within the panel portion.

FIG. 5 is a cross-sectional view of an essential part of a panel portion of an embodiment of the color cathode ray tube in accordance with the present invention, taken in a plane parallel with its tube axis, for explaining the condition of the shadow mask structure mounted within the panel portion. The same reference numerals or characters as utilized in FIG. 8 designate functionally similar portions in FIG. 5. As shown in FIG. 5, the joint portion 83A of the suspension spring 8 is disposed closer to the frame 7, and therefore the spacing d between the joint portion 83B and the tip of the stud 9 is increased by a distance approximately equal to a decrease in spacing between the joint portion 83 and the frame 7. In the above embodiment, the spacing d is selected to be 2.4 mm, but it is sufficient to select the spacing d to be at least 1.9 mm, and it is preferable to select the spacing d to be 2.4 mm or more.

Further, in the above embodiment, the tilt angle θ of the sloped portion 822 is selected to be 9.3 degrees. The tilt angle θ of the sloped portion 822 will now be discussed in detail.

The amount of doming occurring in a shadow mask made of Invar is approximately in a range of from one seventh to one fourth of that in a shadow mask made of aluminum-killed steel, and therefore the amount of compensation of doming in the shadow mask made of Invar, by a suspension spring needs to be smaller than that in the shadow mask made of aluminum-killed steel.

The tilt angle θ of the sloped portion 822 of the suspension spring 8 is about 40 degrees in the case of the shadow mask made of aluminum-killed steel, but in the case of the shadow mask made of Invar, the proper amount of compensation of doming is obtained by selecting the tilt angle θ of the sloped portion 822 to be equal to or smaller than 10 degrees. In view of ease of removing and remounting of the shadow mask structure, and the tilt angle θ is also selected such that the border line between the sloped portion 822 and the flat portion 821 lies on the panel-skirt side of an imaginary line which is parallel with the tube axis and which is in a plane containing the frame-7-side surface of the joint portion 83B, that is to say, the tilt angle θ is selected so as to satisfy $0° \leqq \theta \leqq 10°$.

In this embodiment, the length L of the sloped portion 822 is selected to be 22.1 mm. The length L of the sloped portion 822 will now be discussed in detail.

As explained above, the spacing d needs to be 1.9 mm or more for preventing the joint portions 83 of the suspension spring 8 from contacting the stud 9 during the operations of removing and remounting of the shadow mask structure. In FIG. 5 illustrating the condition of the suspension spring 8 engaged with the stud 9, a distance g between an intersection HCEN of the central axis A—A of the stud pin 9 with a panel-skirt-side plane of the engagement hole 824 and the tip of the stud 9 is usually about 1.7 mm. For making the tilt angle θ of the sloped portion 822 equal to or smaller than 10 degrees, the length L of the sloped portion 822 needs to satisfy the following inequality:

$$\sin 10° \geqq (g+d)/L,$$

$$\text{whence } L \geqq (g+d)/\sin 10°.$$

When the above numerical values for g and d are substituted, this becomes $L \geqq (g+d)/\sin 10° = (1.9\text{ mm} + 1.7\text{ mm})/\sin 10° \approx 20$ mm.

On the other hand, if the length L of the sloped portion 822 is selected such that the phosphor-screen-side end of the joint portions 83 of the suspension spring 8 extends beyond the phosphor-screen-side end of the frame 7, there arises a problem in that the phosphor-screen-side end of the joint portions 83 collide with the inner surface of the panel portion 1. Therefore the length L of the sloped portion 822 is selected such that the phosphor-screen-side end of the joint portions 83 does not extend beyond the phosphor-screen-side end of the frame 7. Usually the axial length of the frame 7 is in a range of from about 40 mm to about 60 mm.

Further, in the above embodiment, the spacing F between the joint portion 83A and the frame 7 is selected to be 3.0 mm. The spacing F will now be discussed in detail.

A spacing between the frame 7 and the tip of the stud 9 is in a range of from about 5 mm to about 20 mm. As already explained, in FIG. 5 illustrating the condition of the suspension spring 8 engaged with the stud 9, the spacing d is 1.9 mm or more, and the thicknesses of the base member 81 and the spring member 82 are about 1 mm and about 0.6 mm, respectively, and therefore 0 mm<F≦20 mm−(d+1+0.6) mm=(20−3.5) mm=16.5 mm.

Further, in the above embodiment, the engaged-disengaged spring-member shift H is selected to be 5 mm. As explained above, when the length L of the spring-action-producing sloped portion 822 of the suspension spring 8 is increased, the pressure exerted against the stud 9 by the suspension spring 8 engaged with the stud 9 is weakened. As is apparent from FIG. 4, when the length L of the sloped portion 822 is selected to be 20 mm or more, the sufficient pressure is obtained by setting the engaged-disengaged spring-member shift H to be 5 mm or more. On the other hand, if the engaged-disengaged spring-member shift H exceeds 15 mm, this makes it difficult for a machine to perform the operations of removing and remounting the shadow mask structure, and it is preferable to satisfy the following inequality:

$$5\ \text{mm} \leqq H \leqq 15\ \text{mm}.$$

The above embodiment uses material widely used for conventional suspension springs, the same width and thickness as in the case of the conventional suspension springs. Therefore the engaged-disengaged spring-member shift H depends upon material used for it, and it can be arbitrarily selected if a sufficient pressure is exerted by the suspension spring against the stud.

For example, the base member 81 and the spring member 82 are made of stainless steel such as JIS (Japanese Industrial Standards) SUS 304, 420J or 631 stainless steel, the spring member 82 is 0.6 mm thick, the base member 81 is selected to be 1.0 mm thick, thicker than the spring member 82 so as to prevent mechanical deformation, the width of the base member 81 and the spring member 82 is 20 mm, and the diameter of the stud 9 is 5.6 mm.

The following explains an example of the overall configuration of the color cathode ray tube employing the above-explained suspension springs.

Figure 6:
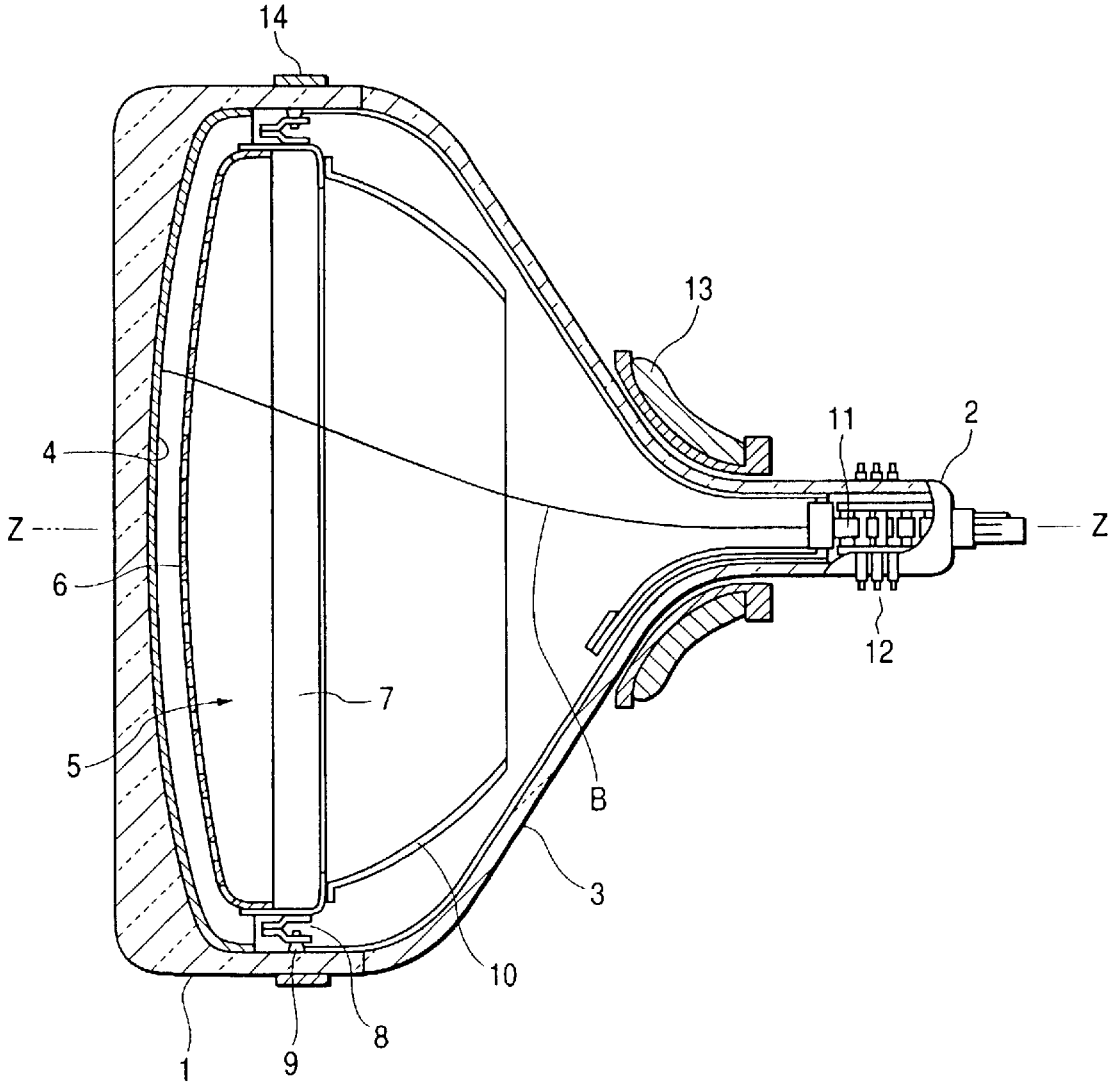
FIG. 6 is a schematic cross-sectional view of an embodiment of the color cathode ray tube in accordance with the present invention for explaining its exemplary overall construction.
Figure 7:
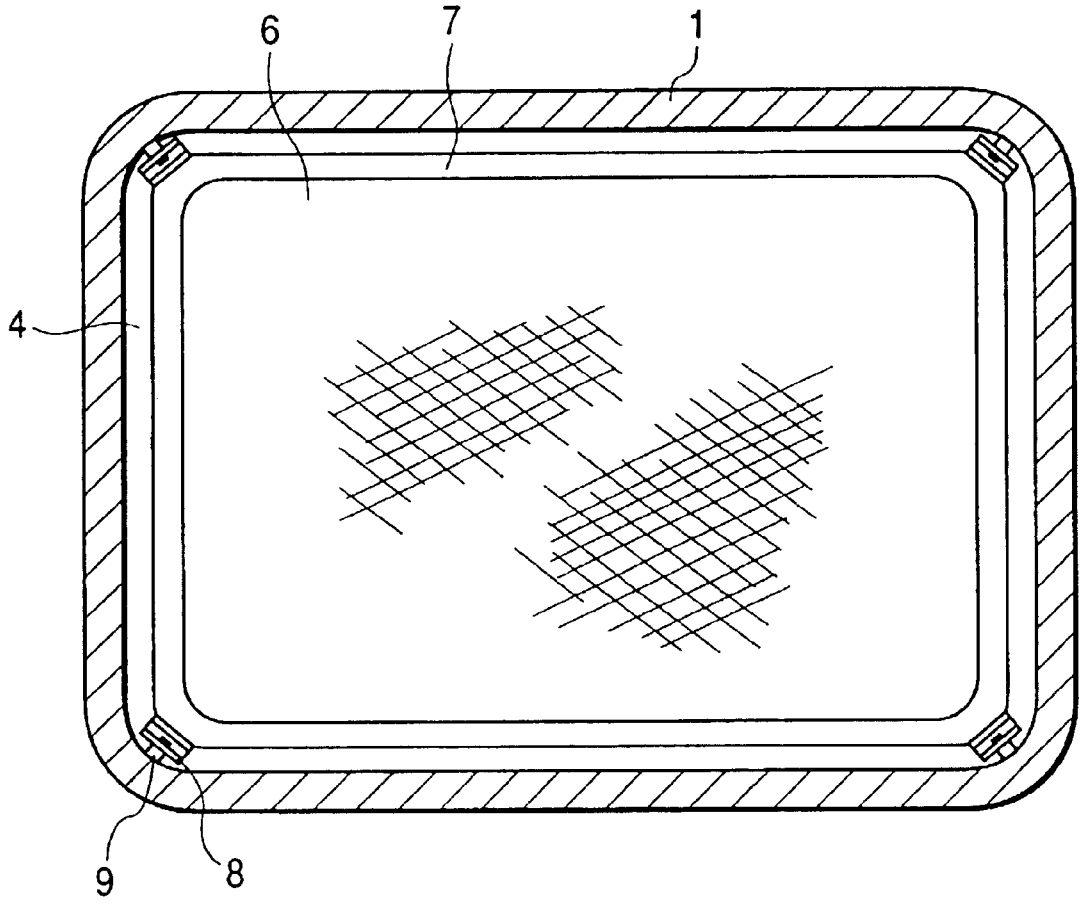
FIG. 7 is a schematic plan view of a shadow mask structure having suspension springs attached at its corners, as viewed from an electron gun side of a color cathode ray tube mounting the shadow mask structure.

FIG. 6 is a schematic cross-sectional view of an embodiment of the color cathode ray tube in accordance with the present invention for explaining its exemplary overall construction. FIG. 6 is a cross-sectional view of the color cathode ray tube taken along a plane containing the tube axis Z—Z and two corners of the panel portion 1, and each of the four studs 9 is embedded in the inner wall of the skirt portion at a respective corner of the panel portion 1.

The color cathode ray tube has the panel portion 1 in the shape of a generally rectangular shallow dish with a skirt portion at its periphery. The phosphor screen 4 is formed on the inner surface of the panel portion 1. The shadow mask structure 5 comprised of the frame 7, the shadow mask 6 made of material having a low coefficient of thermal expansion, and the suspension springs 8 is closely spaced from the phosphor screen 4 within the panel portion 1. The electron gun 11 is housed within the tubular neck portion 2 coupled to the panel portion 1 via the truncated-cone-shaped funnel portion 3.

A deflection yoke 13 is mounted around the outside of the color cathode ray tube in the vicinity of a transition region between the funnel portion 3 and the neck portion 2, and magnetic devices 12 for color purity adjustment and static convergence adjustment are mounted around the neck portion 2. Reference numeral 14 in FIG. 6 denotes an implosion protection band tightly wound around the outside of the skirt portion of the panel portion 1.

The shadow mask structure 5 used in this color cathode ray tube is attached to the panel portion 1 by engaging the suspension springs 8 fixed at the corners of the shadow mask structure with studs 9, and the suspension springs 8 described in any of the above-described embodiments may be used.

The color cathode ray tubes of the above configurations are capable of providing a color-misregister-free high-quality image.

As explained above, the color cathode ray tubes of the representative configurations of the present invention are capable of optimizing the amount of doming compensation by suppressing overcompensation for doming caused by the suspension springs, preventing color misregister due to temperature rise, and thereby providing a high-quality image. The color cathode ray tubes of the present invention are also capable of avoiding interference between the suspension springs and studs in removing and remounting of the shadow mask structure in their manufacturing process, preventing destruction of studs, and thereby improving efficiency in their manufacturing operation.

What is claimed is:

1. A color cathode ray tube comprising:

an evacuated envelope including a generally rectangular shallow dish-like panel portion having a peripheral skirt portion, a tubular neck portion, and a funnel portion for connecting said peripheral skirt portion of said panel portion and said neck portion;

an electron gun housed within said neck portion;

a phosphor screen formed on an inner surface of said panel portion;

a shadow mask structure closely spaced from said phosphor screen within said panel portion;

said shadow mask structure comprising a generally rectangular peripheral frame, a generally rectangular shadow mask attached to said peripheral frame and having an apertured portion formed with a multiplicity of electron-transmissive apertures, and suspension springs attached to corners of said peripheral frame corresponding to corners of said panel portion; and a plurality of studs embedded in an inner wall of said skirt portion at said corners of said panel portion for supporting said shadow mask structure;

wherein each of said suspension springs comprises:

a base member including an electron-gun-side end portion attached to said peripheral frame, a sloped portion extending from said electron-gun-side end portion toward said inner wall of said skirt portion of said panel portion, and a first joint portion extending in a direction of a longitudinal axis of said color cathode ray tube from said sloped portion; and a spring member including a second joint portion fixed to said first joint portion of said base member, a resilient sloped portion extending at a tilt angle θ from said second joint portion of said spring member toward said inner wall of said skirt portion of said panel portion, and a stud-engaging portion extending from said resilient sloped portion, bent from a plane of said resilient sloped portion toward said peripheral frame, and formed with an engagement hole to be engaged with a corresponding one of said plurality of studs, and a length L of said resilient sloped portion satisfies the following inequality:

20 mm≦L≦an axial length of said frame, and said tilt angle θ satisfies the following inequality:

$$0° \leqq \theta \leqq 10°,$$

where said tilt angle θ is an angle measured in a state where said engagement hole is engaged with said corresponding one of said plurality of studs.

2. A color cathode ray tube according to claim 1, wherein a distance between a tip of each of said plurality of studs and a plane containing a surface of said second joint portion of said spring member facing said peripheral skirt portion is at least 1.9 mm in the state where said engagement hole is engaged with said corresponding one of said plurality of studs.

3. A color cathode ray tube according to claim 1, wherein a distance F between said frame and a surface of said first joint portion of said base member facing said peripheral frame satisfies the following inequality:

$$0 < F \leqq 16.5 \text{ mm},$$

where F is measured in the state where said engagement hole is engaged with said corresponding one of said plurality of studs.

4. A color cathode ray tube according to claim 1, wherein a shift in position between a stud-engaging-portion-side end of said resilient sloped portion before said engagement hole is engaged with said corresponding one of said plurality of studs and that in the state where said engagement hole is engaged with said corresponding one of said plurality of studs, measured in a direction perpendicular to the axis of said color cathode ray tube is in a range of from 5 mm to 15 mm.

* * * * *